US011626050B2

(12) United States Patent
Tao

(10) Patent No.: US 11,626,050 B2
(45) Date of Patent: Apr. 11, 2023

(54) GOA CIRCUIT AND DISPLAY PANEL

(71) Applicant: WUHAN CHINA STAR OPTOELECTRONICS TECHNOLOGY CO., LTD., Wuhan (CN)

(72) Inventor: Jian Tao, Wuhan (CN)

( * ) Notice: Subject to any disclaimer, the term of this patent is extended or adjusted under 35 U.S.C. 154(b) by 308 days.

(21) Appl. No.: 16/972,635

(22) PCT Filed: Sep. 24, 2020

(86) PCT No.: PCT/CN2020/117334
§ 371 (c)(1),
(2) Date: Dec. 7, 2020

(87) PCT Pub. No.: WO2022/011836
PCT Pub. Date: Jan. 20, 2022

(65) Prior Publication Data

US 2022/0319370 A1 Oct. 6, 2022

(30) Foreign Application Priority Data

Jul. 13, 2020 (CN) ..... 202010669594.0

(51) Int. Cl.
*G09G 3/20* (2006.01)

(52) U.S. Cl.
CPC ..... *G09G 3/20* (2013.01); *G09G 2300/0408* (2013.01); *G09G 2300/08* (2013.01); *G09G 2310/0267* (2013.01); *G09G 2310/0283* (2013.01); *G09G 2310/08* (2013.01)

(58) Field of Classification Search
None
See application file for complete search history.

(56) References Cited

U.S. PATENT DOCUMENTS

| | | | | |
|---|---|---|---|---|
| 10,269,320 | B1 | 4/2019 | Gong | |
| 2009/0304139 | A1 | 12/2009 | Tsai et al. | |
| 2010/0260312 | A1 | 10/2010 | Tsai et al. | |
| 2017/0358267 | A1 | 12/2017 | Feng et al. | |
| 2018/0182300 | A1 | 6/2018 | Chen et al. | |
| 2018/0218700 | A1* | 8/2018 | Zeng | G09G 3/3677 |
| 2018/0219475 | A1* | 8/2018 | Cao | G09G 3/20 |
| 2019/0156777 | A1 | 5/2019 | Xiao et al. | |
| 2019/0311691 | A1 | 10/2019 | Feng et al. | |
| 2019/0333597 | A1 | 10/2019 | Liu et al. | |
| 2019/0385556 | A1 | 12/2019 | Guan | |

(Continued)

FOREIGN PATENT DOCUMENTS

| | | | |
|---|---|---|---|
| CN | 105096889 | A | 11/2015 |
| CN | 205282054 | U | 6/2016 |
| CN | 107403612 | A | 11/2017 |

(Continued)

*Primary Examiner* — Sejoon Ahn

(57) ABSTRACT

The present disclosure provides a gate driver on array (GOA) circuit and a display panel. The GOA circuit includes multi-level cascaded GOA units. Each of the GOA units includes a pull-up control module, a pull-up module, a pull-down module, a pull-down maintenance module and a bootstrap capacitor. By sharing part of the circuit, each of the GOA units can realize multi-level scanning signal outputting, which simplifies the structure of the GOA circuit and further realizes a narrow frame design of display panels.

20 Claims, 4 Drawing Sheets

(56) References Cited

U.S. PATENT DOCUMENTS

| | | | |
|---|---|---|---|
| 2020/0098327 | A1 | 3/2020 | Dai |
| 2020/0302847 | A1 | 9/2020 | Zhao |

FOREIGN PATENT DOCUMENTS

| | | | |
|---|---|---|---|
| CN | 107767833 | A | 3/2018 |
| CN | 107767834 | A | 3/2018 |
| CN | 107799083 | A | 3/2018 |
| CN | 107871483 | A | 4/2018 |
| CN | 107958656 | A | 4/2018 |
| CN | 107993620 | A | 5/2018 |
| CN | 108154836 | A | 6/2018 |
| CN | 108288460 | A | 7/2018 |
| CN | 109300428 | A | 2/2019 |
| CN | 109979370 | A | 7/2019 |
| CN | 110930918 | A | 3/2020 |

* cited by examiner

GOA CIRCUIT AND DISPLAY PANEL

BACKGROUND OF INVENTION

Field of Invention

The present disclosure relates to a field of display, and more particularly to a gate driver on array (GOA) circuit and a display panel.

A gate driver on array (GOA) integrates a gate driver circuit on an array substrate of a display panel to achieve a progressive scan driving mode, which can reduce a gate driver circuit. It has the advantages of reducing production costs and realizing a narrow frame design of panels, and is used by a variety of displays.

SUMMARY

In a GOA circuit of the prior art, each GOA unit outputs a scanning signal to a corresponding gate line in a display panel. The GOA circuit occupies a large wiring space, which is not conducive to achieve a narrow frame design.

The present disclosure provides a GOA circuit and a display panel to solve the problem in the prior art that the GOA circuit occupies a large wiring space and is not conducive to achieve a narrow frame design.

The present disclosure provides a GOA circuit, the GOA circuit includes multi-level cascaded GOA units, the GOA unit at each level includes: a pull-up control module, a pull-up module, a pull-down module, a pull-down maintenance module, and a bootstrap capacitor; the pull-up control module accesses an Nth level scanning signal and a forward scanning signal, the pull-up control module is electrically connected to a first node, the pull-up control module is configured to output the forward scanning signal to the first node under control of the Nth level scanning signal; the pull-up module accesses a high-level signal and at least two clock signals, the pull-up module is electrically connected to the first node, the pull-up module is configured to output a scanning signal corresponding to each of the clock signals under control of the high-level signal, the clock signals, and electric potential control of the first node; the pull-down module accesses the forward scanning signal, a reverse scanning signal, an N+5th level clock signal, an Nth level clock signal, an N+5th level scanning signal, the high-level signal, and a low-level signal, the pull-down module is electrically connected to the first node and a second node, the pull-down module is configured to pull down the electric potential of the first node under control of the forward scanning signal, the reverse scanning signal, the N+5th level clock signal, the Nth level clock signal, the N+5th level scanning signal, the high-level signal and the low-level signal; the pull-down maintenance module accesses the low-level signal and a function control signal, the pull-down maintenance module is electrically connected to the first node, the second node and an output terminal for outputting the scanning signals, the pull-down maintenance module is configured to maintain a low electric potential of the first node and the corresponding scanning signal under control of the electric potential of the second node and the low-level signal; a first end of the bootstrap capacitor accesses the low-level signal, and a second end of the bootstrap capacitor is electrically connected to the first node.

In the GOA circuit provided by the present disclosure, the pull-up control module includes a first transistor; a gate of the first transistor accesses the Nth level scanning signal, a source of the first transistor accesses the forward scanning signal, and a drain of the first transistor is electrically connected to the first node.

In the GOA circuit provided by the present disclosure, the pull-up module includes a second transistor, a third transistor, and a fourth transistor; a gate of the second transistor accesses the high-level signal, a source of the second transistor is electrically connected to the first node, a drain of the second transistor, a gate of the third transistor and a gate of the fourth transistor are both electrically connected to a pull-up node, a source of the third transistor accesses an N+2th level clock signal, a drain of the third transistor is electrically connected to an output terminal for outputting an N+2th level scanning signal, a source of the fourth transistor accesses an N+3th level clock signal, a drain of the fourth transistor is electrically connected to an output terminal for outputting an N+3th level scanning signal.

In the GOA circuit provided by the present disclosure, the pull-up module includes a second transistor, a third transistor, a fourth transistor, and a fifth transistor; a gate of the second transistor and a gate of the fifth transistor both access the high-level signal, a source of the second transistor and a source of the fifth transistor are both electrically connected to the first node, a drain of the second transistor and a gate of the third transistor are both electrically connected to a first pull-up node, a source of the third transistor accesses an N+2th level clock signal, a drain of the third transistor is electrically connected to an output terminal for outputting an N+2th level scanning signal, a drain of the fifth transistor and a gate of the fourth transistor are both electrically connected to a second pull-up node, a source of the fourth transistor accesses an N+3th level clock signal, a drain of the fourth transistor is electrically connected to an output terminal for outputting an N+3th level scanning signal.

In the GOA circuit provided by the present disclosure, the pull-down maintenance module includes a sixth transistor, a seventh transistor, an eighth transistor, a ninth transistor, and a second capacitor; a gate of the sixth transistor, a first end of the second capacitor, a drain of the seventh transistor, a gate of the eighth transistor, and a gate of the ninth transistor are all electrically connected to the second node, a drain of the sixth transistor is electrically connected to the first node, a source of the sixth transistor, a second end of the second capacitor, a source of the seventh transistor, a source of the eighth transistor, and a source of the ninth transistor all access the low-level signal, a gate of the seventh transistor accesses the function control signal, a drain of the eighth transistor is electrically connected to the output terminal for outputting the N+2th level scanning signal, a drain of the ninth transistor is electrically connected to the output terminal for outputting the N+3th level scanning signal.

In the GOA circuit provided by the present disclosure, the pull-up module includes a second transistor, a third transistor, a fourth transistor, a fifth transistor, a tenth transistor and an eleventh transistor; a gate of the second transistor, a gate of the fifth transistor, and a gate of the tenth transistor all access the high-level signal, a source of the second transistor, a source of the fifth transistor and a source of the tenth transistor are all electrically connected to the first node, a drain of the second transistor and a gate of the third transistor are both electrically connected to a first pull-up node, a source of the third transistor accesses an N+2th level clock signal, a drain of the third transistor is electrically connected to an output terminal for outputting an N+2th level scanning signal, a drain of the fifth transistor and a gate of the fourth transistor are both electrically connected to a second pull-up node, a source of the fourth transistor accesses an N+3th level clock signal, a drain of the fourth transistor is electrically connected to an output terminal for outputting an N+3th level scanning signal, a drain of the tenth transistor and a gate of the eleventh transistor are both electrically connected to a third pull-up node, a source of the eleventh transistor accesses an N+4th clock signal, a drain of the eleventh transistor is electrically connected to an output terminal for outputting an N+4th level scanning signal.

In the GOA circuit provided by the present disclosure, the pull-down maintenance module includes a sixth transistor, a seventh transistor, an eighth transistor, a ninth transistor, a twelfth transistor, and a second capacitor; a gate of the sixth transistor, a first end of the second capacitor, a drain of the seventh transistor, a gate of the eighth transistor, a gate of the ninth transistor, and a gate of the twelfth transistor are all electrically connected to the second node, a drain of the sixth transistor is electrically connected to the first node, a source of the sixth transistor, a second end of the second capacitor, a source of the seventh transistor, a source of the eighth transistor, a source of the ninth transistor, and a source of the twelfth transistor all access the low-level signal, a gate of the seventh transistor accesses the function control signal, a drain of the eighth transistor is electrically connected to the output terminal for outputting the N+2th level scanning signal, a drain of the ninth transistor is electrically connected to the output terminal for outputting the N+3th level scanning signal, a drain of the twelfth transistor is electrically connected to the output terminal for outputting the N+4th level scanning signal.

In the GOA circuit provided by the present disclosure, the pull-down module includes a thirteenth transistor, a fourteenth transistor, a fifteenth transistor, a sixteenth transistor, and a seventeenth transistor; a gate of the thirteenth transistor accesses the forward scanning signal, a source of the thirteenth transistor accesses the N+5th level clock signal, a drain of the thirteenth transistor is electrically connected to a drain of the fourteenth transistor and a gate of the fifteenth transistor, a source of the fourteenth transistor accesses the Nth level clock signal, a gate of the fourteenth transistor and a source of the sixteenth transistor both access the reverse scanning signal, a gate of the sixteenth transistor accesses the N+5th level scanning signal, a drain of the sixteenth transistor and a gate of the seventeenth transistor are both electrically connected to the first node, a source of the seventeenth transistor accesses the low-level signal, a drain of the seventeenth transistor and a drain of the fifteenth transistor are both electrically connected to the second node, a source of the fifteenth transistor accesses the high-level signal.

In the GOA circuit provided by the present disclosure, a phase of the forward scanning signal is opposite to a phase of the reverse scanning signal.

Correspondingly, the present disclosure provides a display panel, the display panel includes a GOA circuit, the GOA circuit includes multi-level cascaded GOA units, the GOA unit at each level includes: a pull-up control module, a pull-up module, a pull-down module, a pull-down maintenance module, and a bootstrap capacitor; the pull-up control module accesses an Nth level scanning signal and a forward scanning signal, the pull-up control module is electrically connected to a first node, the pull-up control module is configured to output the forward scanning signal to the first node under control of the Nth level scanning signal; the pull-up module accesses a high-level signal and at least two clock signals, the pull-up module is electrically connected to the first node, the pull-up module is configured to output a scanning signal corresponding to each of the clock signals under control of the high-level signal, the clock signals, and electric potential control of the first node; the pull-down module accesses the forward scanning signal, a reverse scanning signal, an N+5th level clock signal, an Nth level clock signal, an N+5th level scanning signal, the high-level signal, and a low-level signal, the pull-down module is electrically connected to the first node and a second node, the pull-down module is configured to pull down the electric potential of the first node under control of the forward scanning signal, the reverse scanning signal, the N+5th level clock signal, the Nth level clock signal, the N+5th level scanning signal, the high-level signal and the low-level signal; the pull-down maintenance module accesses the low-level signal and a function control signal, the pull-down maintenance module is electrically connected to the first node, the second node and an output terminal for outputting the scanning signals, the pull-down maintenance module is configured to maintain a low electric potential of the first node and the corresponding scanning signal under control of the electric potential of the second node and the low-level signal; a first end of the bootstrap capacitor accesses the low-level signal, and a second end of the bootstrap capacitor is electrically connected to the first node.

In the display panel provided by the present disclosure, the pull-up control module includes a first transistor; a gate of the first transistor accesses the Nth level scanning signal, a source of the first transistor accesses the forward scanning signal, and a drain of the first transistor is electrically connected to the first node.

In the display panel provided by the present disclosure, the pull-up module includes a second transistor, a third transistor, and a fourth transistor; a gate of the second transistor accesses the high-level signal, a source of the second transistor is electrically connected to the first node, a drain of the second transistor, a gate of the third transistor, and a gate of the fourth transistor are all electrically connected to a pull-up node, a source of the third transistor accesses an N+2th level clock signal, a drain of the third transistor is electrically connected to an output terminal for outputting an N+2th level scanning signal, a source of the fourth transistor accesses an N+3th level clock signal, a drain of the fourth transistor is electrically connected to an output terminal for outputting an N+3th level scanning signal.

In the display panel provided by the present disclosure, the pull-down maintenance module includes a sixth transistor, a seventh transistor, an eighth transistor, a ninth transistor, and a second capacitor; a gate of the sixth transistor, a first end of the second capacitor, a drain of the seventh transistor, a gate of the eighth transistor, and a gate of the ninth transistor are all electrically connected to the second node, a drain of the sixth transistor is electrically connected to the first node, a source of the sixth transistor, a second end of the second capacitor, a source of the seventh transistor, a source of the eighth transistor, and a source of the ninth transistor all access the low-level signal, a gate of the seventh transistor accesses the function control signal, a drain of the eighth transistor is electrically connected to the output terminal for outputting the N+2th level scanning signal, a drain of the ninth transistor is electrically connected to the output terminal for outputting the N+3th level scanning signal.

In the display panel provided by the present disclosure, the pull-up module includes a second transistor, a third transistor, a fourth transistor, and a fifth transistor; a gate of the second transistor and a gate of the fifth transistor both access the high-level signal, a source of the second transistor and a source of the fifth transistor are both electrically connected to the first node, a drain of the second transistor and a gate of the third transistor are both electrically connected to a first pull-up node, a source of the third transistor accesses an N+2th level clock signal, a drain of the third transistor is electrically connected to an output terminal for outputting an N+2th level scanning signal, a drain of the fifth transistor and a gate of the fourth transistor are both electrically connected to a second pull-up node, a source of the fourth transistor accesses an N+3th level clock signal, a drain of the fourth transistor is electrically connected to an output terminal for outputting an N+3th level scanning signal.

In the display panel provided by the present disclosure, the pull-down maintenance module includes a sixth transistor, a seventh transistor, an eighth transistor, a ninth transistor, and a second capacitor; a gate of the sixth transistor, a first end of the second capacitor, a drain of the seventh transistor, a gate of the eighth transistor, and a gate of the ninth transistor are all electrically connected to the second node, a drain of the sixth transistor is electrically connected to the first node, a source of the sixth transistor, a second end of the second capacitor, a source of the seventh transistor, a source of the eighth transistor, and a source of the ninth transistor all access the low-level signal, a gate of the seventh transistor accesses the function control signal, a drain of the eighth transistor is electrically connected to the output terminal for outputting the N+2th level scanning signal, a drain of the ninth transistor is electrically connected to the output terminal for outputting the N+3th level scanning signal.

In the display panel provided by the present disclosure, the pull-up module includes a second transistor, a third transistor, a fourth transistor, a fifth transistor, a tenth transistor and an eleventh transistor; a gate of the second transistor, a gate of the fifth transistor, and a gate of the tenth transistor all access the high-level signal, a source of the second transistor, a source of the fifth transistor, and a source of the tenth transistor are all electrically connected to the first node, a drain of the second transistor and a gate of the third transistor are both electrically connected to a first pull-up node, a source of the third transistor accesses an N+2th level clock signal, a drain of the third transistor is electrically connected to an output terminal for outputting an N+2th level scanning signal, a drain of the fifth transistor and a gate of the fourth transistor are both electrically connected to a second pull-up node, a source of the fourth transistor accesses an N+3th level clock signal, a drain of the fourth transistor is electrically connected to an output terminal for outputting an N+3th level scanning signal, a drain of the tenth transistor and a gate of the eleventh transistor are both electrically connected to a third pull-up node, a source of the eleventh transistor accesses an N+4th clock signal, a drain of the eleventh transistor is electrically connected to an output terminal for outputting an N+4th level scanning signal.

In the display panel provided by the present disclosure, the pull-down maintenance module includes a sixth transistor, a seventh transistor, an eighth transistor, a ninth transistor, a twelfth transistor, and a second capacitor; a gate of the sixth transistor, a first end of the second capacitor, a drain of the seventh transistor, a gate of the eighth transistor, a gate of the ninth transistor, and a gate of the twelfth transistor are all electrically connected to the second node, a drain of the sixth transistor is electrically connected to the first node, a source of the sixth transistor, a second end of the second capacitor, a source of the seventh transistor, a source of the eighth transistor, a source of the ninth transistor, and a source of the twelfth transistor all access the low-level signal, a gate of the seventh transistor accesses the function control signal, a drain of the eighth transistor is electrically connected to the output terminal for outputting the N+2th level scanning signal, a drain of the ninth transistor is electrically connected to the output terminal for outputting the N+3th level scanning signal, a drain of the twelfth transistor is electrically connected to the output terminal for outputting the N+4th level scanning signal.

In the display panel provided by the present disclosure, the pull-down module includes a thirteenth transistor, a fourteenth transistor, a fifteenth transistor, a sixteenth transistor, and a seventeenth transistor; a gate of the thirteenth transistor accesses the forward scanning signal, a source of the thirteenth transistor accesses the N+5th level clock signal, a drain of the thirteenth transistor is electrically connected to a drain of the fourteenth transistor and a gate of the fifteenth transistor, a source of the fourteenth transistor accesses the Nth level clock signal, a gate of the fourteenth transistor and a source of the sixteenth transistor both access the reverse scanning signal, a gate of the sixteenth transistor accesses the N+5th level scanning signal, a drain of the sixteenth transistor and a gate of the seventeenth transistor are both electrically connected to the first node, a source of the seventeenth transistor accesses the low-level signal, a drain of the seventeenth transistor and a drain of the fifteenth transistor are both electrically connected to the second node, a source of the fifteenth transistor accesses the high-level signal.

In the display panel provided by the present disclosure, a phase of the forward scanning signal is opposite to a phase of the reverse scanning signal.

The present disclosure provides a GOA circuit and a display panel, the GOA circuit includes multi-level cascaded GOA units, each of the GOA units includes a pull-up control module, a pull-up module, a pull-down module, a pull-down maintenance module, and a bootstrap capacitor. Each of the GOA units can realize multi-level scanning signal outputting by sharing part of the circuit, which simplifies the structure of the GOA circuit, and further realizes the narrow frame design of the display panel.

BRIEF DESCRIPTION OF DRAWINGS

In order to describe the technical solutions in the embodiments of the present disclosure more clearly, the following will briefly introduce the drawings needed in the description of the embodiments. Obviously, the drawings in the following description are only some embodiments of the present disclosure. For those skilled in the art, other drawings can be obtained based on these drawings without creative work.

DETAILED DESCRIPTION OF EMBODIMENTS

The technical solutions in the embodiments of the present disclosure will be described clearly and completely in conjunction with the accompanying drawings. Obviously, the embodiments described are only a part of the embodiments of the present disclosure, rather than all the embodiments. Based on the embodiments of the present disclosure, all other embodiments obtained by those skilled in the art without creative work shall fall within the protection scope of the present disclosure.

In the description of the present disclosure, it should be understood that the terms "first" and "second" are only used for descriptive purposes, and cannot be understood as indicating or implying relative importance or implicitly indicating the number of indicated technical features. Therefore, the features defined as "first" and "second" may explicitly or implicitly include one or more of the features, and therefore cannot be understood as a limitation of the present disclosure.

The transistors used in all the embodiments of the present disclosure can be thin film transistors, field effect transistors, or other devices with the same characteristics. Since the source and drain of the transistors used here are symmetrical, the source and drain can be interchanged. In the embodiments of the present disclosure, in order to distinguish the two poles of a transistor except the gate, one of the poles is called the source and the other is called the drain. According to the modes in the FIGS., it is stipulated that the middle part of a switching transistor is the gate, the end for inputting signals is the source, and the end for outputting signals is the drain. In addition, the transistors used in the embodiments of the present disclosure may include P-type transistors and/or N-type transistors. The P-type transistor is turned on when the gate is at a low level, and is turned off when the gate is at a high level. The N-type transistor is turned on when the gate is at a high level, and is turned off when the gate is at a low level.

It should be noted that the transistors in the following embodiments of the present disclosure are all described by taking N-type transistors as examples, but they should not be understood as a limitation of the present disclosure.

Figure 1:
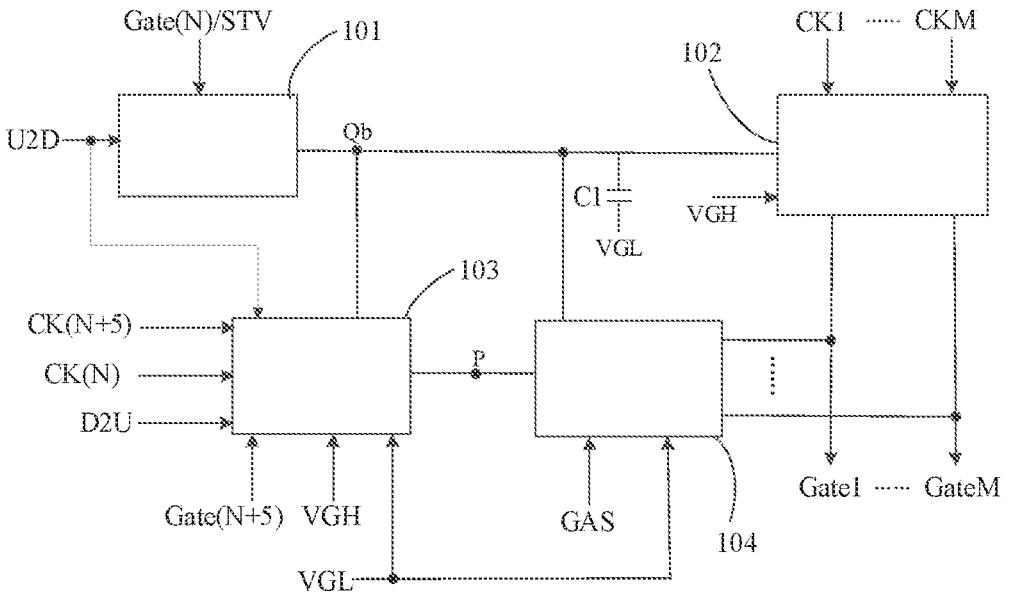
FIG. 1 is a schematic structural diagram of a gate driver on array (GOA) unit in a GOA circuit provided in one embodiment of the present disclosure.

Please refer to FIG. 1. FIG. 1 is a schematic structural diagram of a GOA unit in a GOA circuit provided in one embodiment of the present disclosure. As shown in FIG. 1, the GOA unit includes: a pull-up control module 101, a pull-up module 102, a pull-down module 103, a pull-down maintenance module 104, and a bootstrap capacitor C1.

The pull-up control module 101 accesses an Nth level scanning signal Gate (N) and a forward scanning signal U2D or a starting signal STV and a forward scanning signal U2D. The pull-up control module 101 is electrically connected to a first node Qb. The pull-up control module 101 is configured to output the forward scanning signal U2D to the first node Qb under control of the Nth level scanning signal Gate (N) or under control of the starting signal STV. N is a positive integer.

The pull-up module 102 accesses at least two clock signals CK and a high-level signal VGH. The pull-up module 102 is electrically connected to the first node Qb and at least two output terminals for outputting scanning signals. The pull-up module 102 is configured to output scanning signals Gate 1-Gate M corresponding to clock signals CK 1-CK M under control of the clock signals CK 1-CK M and the high-level signal VGH. M is a positive integer. M is less than or equal to N.

The pull-down module 103 accesses the forward scanning signal U2D, a reverse scanning signal D2U, an N+5th level clock signal CK (N+5), an Nth level clock signal CK (N), an N+5th level scanning signal Gate (N+5), the high-level signal VGH, and a low-level signal VGL. The pull-down module 103 is electrically connected to the first node Qb and a second node P. The pull-down module 103 is configured to pull down the electric potential of the first node Qb under control of the forward scanning signal U2D, the reverse scanning signal D2U, the N+5th level clock signal CK (N+5), the Nth level clock signal CK (N), the N+5th level scanning signal Gate (N+5), the high-level signal VGH and the low-level signal VGL.

The pull-down maintenance module 104 accesses the low-level signal VGL and a function control signal GAS. The pull-down maintenance module 104 is electrically connected to the first node Qb, the second node P and each output terminal for outputting a scanning signal. The pull-down maintenance module 104 is configured to maintain a low electric potential of the first node Qb and a low electric potential of the corresponding scanning signal under control of the electric potential of the second node P and the low-level signal VGL.

A first end of the bootstrap capacitor C1 accesses the low-level signal VGL. A second end of the bootstrap capacitor C1 is electrically connected to the first node Qb.

In the embodiments of the present disclosure, it should be noted that a phase of the forward scanning signal U2D is opposite to a phase of the reverse scanning signal D2U. When the GOA circuit is at the function opening stage, it may isolate a path between the forward scanning signal U2D and the first node Qb or a path between the reverse scanning signal D2U and the first node Qb through an N−2th level scanning signal Gate (N−2) and an N+2th level scanning signal Gate (N+2). The high-level forward scanning signal U2D or the reverse scanning signal D2U is used for driving, so as to avoid the competition path in the GOA circuit. In each embodiment of the present disclosure, the forward scanning signal U2D is at a high level and the reverse scanning signal D2U is at a low level as examples for description, but it cannot be understood as a limitation of the present disclosure.

The GOA circuit provided in the embodiments of the present disclosure includes multi-level cascaded GOA units, each of the GOA units includes a pull-up control module, a pull-up module, a pull-down module, a pull-down maintenance module, and a bootstrap capacitor. By sharing part of the circuit, each of the GOA units can realize multi-level scanning signal outputting, which simplifies the structure of the GOA circuit, and further realizes a narrow frame design of display panels.

Figure 2:
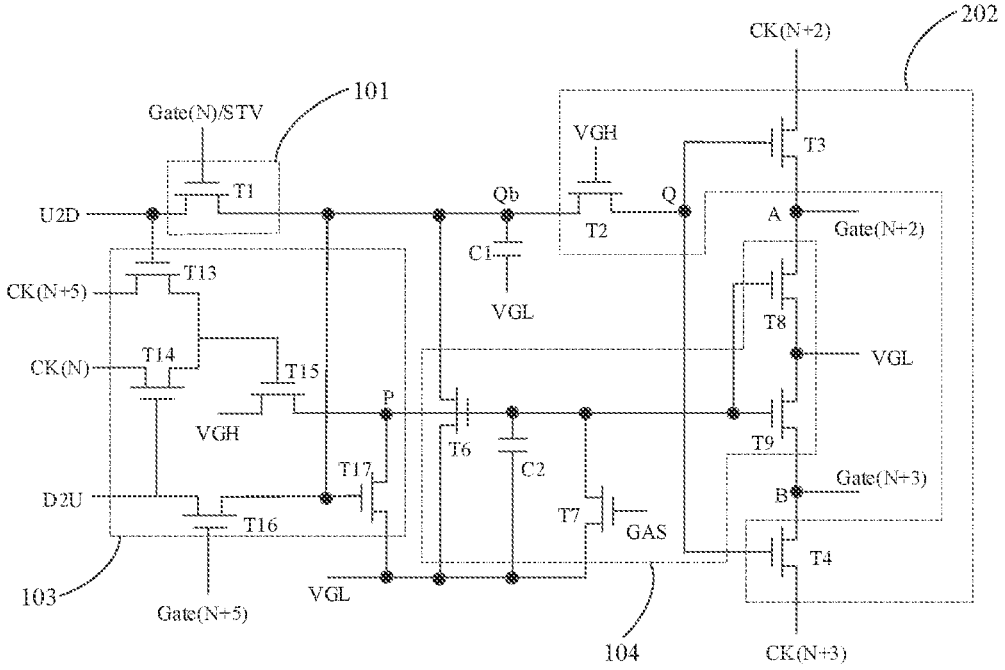
FIG. 2 is a first schematic diagram of a GOA unit in a GOA circuit provided in one embodiment of the present disclosure.

Further, please refer to FIG. 2. FIG. 2 is a first schematic diagram of a GOA unit in a GOA circuit provided in the present disclosure. As shown in FIG. 2, the pull-up control module 101 includes a first transistor T1.

A gate of the first transistor T1 accesses the Nth level scanning signal Gate (N). A source of the first transistor T1 accesses the forward scanning signal U2D. A drain of the first transistor T1 is electrically connected to the first node Qb.

The pull-up module 102 includes a second transistor T2, a third transistor T3, and a fourth transistor T4.

A gate of the second transistor T2 accesses the high-level signal VGH. A source of the second transistor T2 is electrically connected to the first node Qb. A drain of the second transistor T2, a gate of the third transistor T3, and a gate of the fourth transistor T4 are all electrically connected to a pull-up node Q. A source of the third transistor T3 accesses an N+2th level clock signal CK (N+2). A drain of the third transistor T3 is electrically connected to an output terminal A for outputting an N+2th level scanning signal. A source of the fourth transistor T4 accesses an N+3th level clock signal CK (N+3). A drain of the fourth transistor T4 is electrically connected to an output terminal B for outputting an N+3th level scanning signal.

The pull-down module 104 includes a thirteenth transistor T13, a fourteenth transistor T14, a fifteenth transistor T15, a sixteenth transistor T16, and a seventeenth transistor T17.

A gate of the thirteenth transistor T13 accesses the forward scanning signal U2D. A source of the thirteenth transistor T13 accesses the N+5th level clock signal CK (N+5). A drain of the thirteenth transistor T13 is electrically connected to a drain of the fourteenth transistor T14 and a gate of the fifteenth transistor T15. A source of the fourteenth transistor T14 accesses the Nth level clock signal CK (N). A gate of the fourteenth transistor T14 and a source of the sixteenth transistor T16 both access the reverse scanning signal D2U. A gate of the sixteenth transistor T16 accesses the N+5th level scanning signal Gate (N+5). A drain of the sixteenth transistor T16 and a gate of the seventeenth transistor T17 are both electrically connected to the first node Qb. A source of the seventeenth transistor T17 accesses the low-level signal VGL. A drain of the seventeenth transistor T17 and a drain of the fifteenth transistor T15 are both electrically connected to the second node P. A source of the fifteenth transistor T15 accesses the high-level signal VGH.

The pull-down maintenance module 103 includes a sixth transistor T6, a seventh transistor T7, an eighth transistor T8, a ninth transistor T9, and a second capacitor C2.

A gate of the sixth transistor T6, a first end of the second capacitor C2, a drain of the seventh transistor T7, a gate of the eighth transistor T8, and a gate of the ninth transistor T9 are all electrically connected to the second node P. A drain of the sixth transistor T6 is electrically connected to the first node Qb. A source of the sixth transistor T6, a second end of the second capacitor C2, a source of the seventh transistor T7, a source of the eighth transistor T8, and a source of the ninth transistor T9 all access the low-level signal VGL. A gate of the seventh transistor T7 accesses the function control signal GAS. A drain of the eighth transistor T8 is electrically connected to the output terminal A for outputting the N+2th level scanning signal. A drain of the ninth transistor T9 is electrically connected to the output terminal B for outputting the N+3th level scanning signal.

In the embodiments of the present disclosure, by sharing part of the circuit, each GOA unit can correspondingly output the N+2th level scanning signal Gate (N+2) and the N+3th level scanning signal Gate (N+3), which simplifies the structure of the GOA circuit and further realizes a narrow frame design of display panels.

Figure 3:
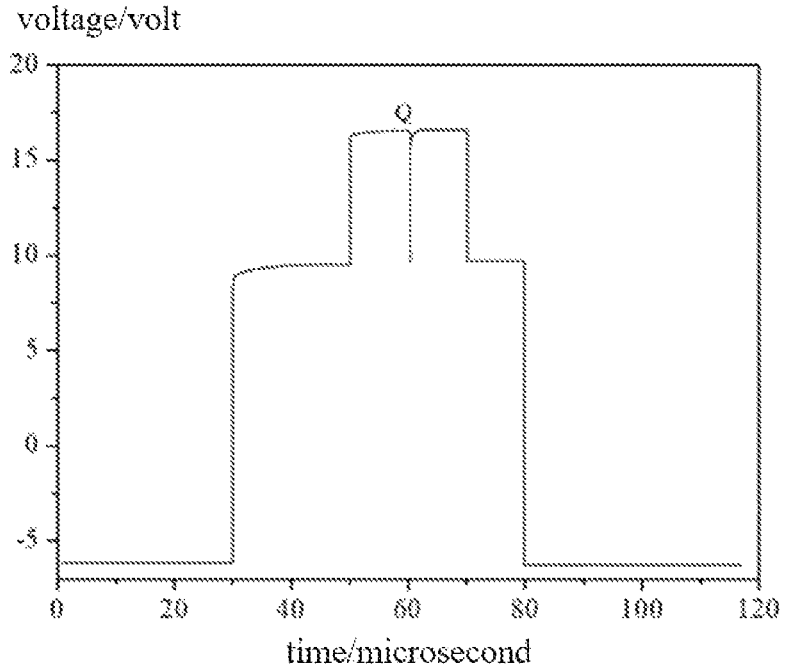
FIG. 3 is a simulation result diagram of a pull-up node in the GOA unit shown in FIG. 2.

However, since the gate of the third transistor T3 and the gate of the fourth transistor T4 are both electrically connected to the pull-up node Q, the bootstrap effect of the pull-up node Q is not good. Specifically, please refer to FIG. 3. FIG. 3 is a simulation result diagram of the pull-up node Q in the GOA unit shown in FIG. 2. The abscissa in FIG. 2 is time, and the time unit is microsecond. The ordinate in FIG. 2 is voltage, and the voltage unit is volt. As shown in FIG. 3, the high-level signal VGH in the GOA circuit is usually 9V. According to the simulation result, the bootstrap voltage amplitude of the pull-up node Q is only 16V, so the gate voltages of the third transistor T3 and the fourth transistor T4 are not high enough, which causes waveform distortion of the output scanning signal. Therefore, the present disclosure further optimizes the GOA circuit.

Figure 4:
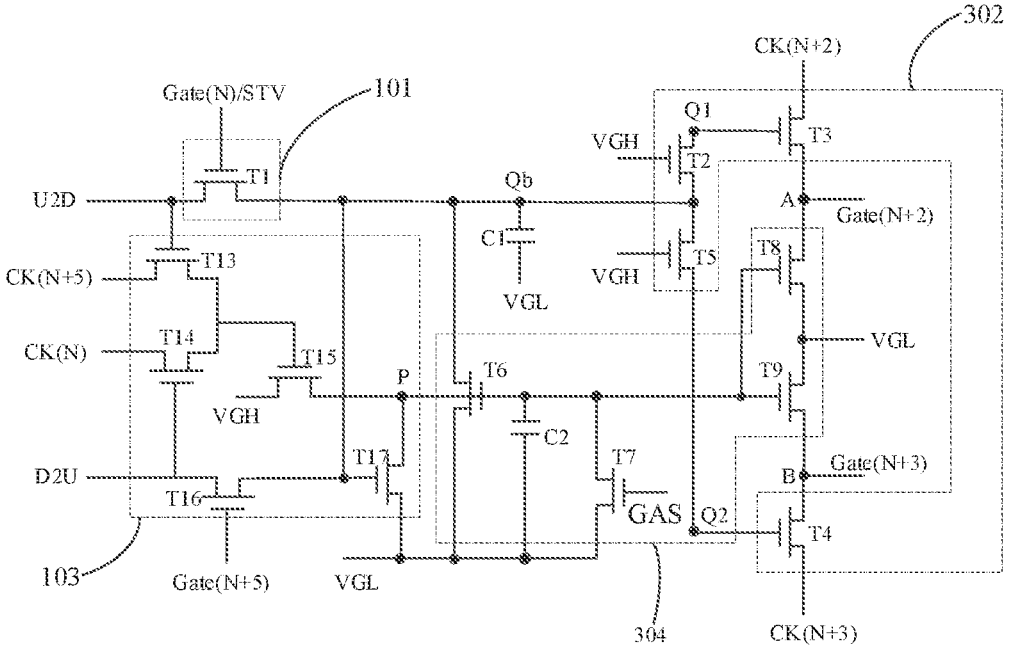
FIG. 4 is a second schematic diagram of a GOA unit in a GOA circuit provided in one embodiment of the present disclosure.

Please refer to FIG. 4. FIG. 4 is a second schematic diagram of a GOA unit in a GOA circuit provided in the present disclosure. As shown in FIG. 4, the difference from the GOA unit shown in FIG. 2 is that the pull-up module 202 includes a second transistor T2, a third transistor T3, a fourth transistor T4, and a fifth transistor T5.

A gate of the second transistor T2 and a gate of the fifth transistor T5 both access the high-level signal VGH. A source of the second transistor T2 and a source of the fifth transistor T5 are both electrically connected to the first node Qb. A drain of the second transistor T2 and a gate of the third transistor T3 are both electrically connected to a first pull-up node Q1. A source of the third transistor T3 accesses an N+2th level clock signal CK (N+2). A drain of the third transistor T3 is electrically connected to an output terminal for outputting an N+2th level scanning signal Gate (N+2). A drain of the fifth transistor T5 and a gate of the fourth transistor T4 are both electrically connected to a second pull-up node Q2. A source of the fourth transistor T4 accesses an N+3th level clock signal CK (N+3). A drain of the fourth transistor T4 is electrically connected to an output terminal B for outputting an N+3th level scanning signal.

In the embodiments of the present disclosure, a fifth transistor T5 is added to the pull-up module 202 to divide the original pull-up node Q into a first pull-up node Q1 and a second pull-up node Q2. The first pull-up node Q1 and the second pull-up node Q2 will not affect each other during bootstrapping.

Figure 5:
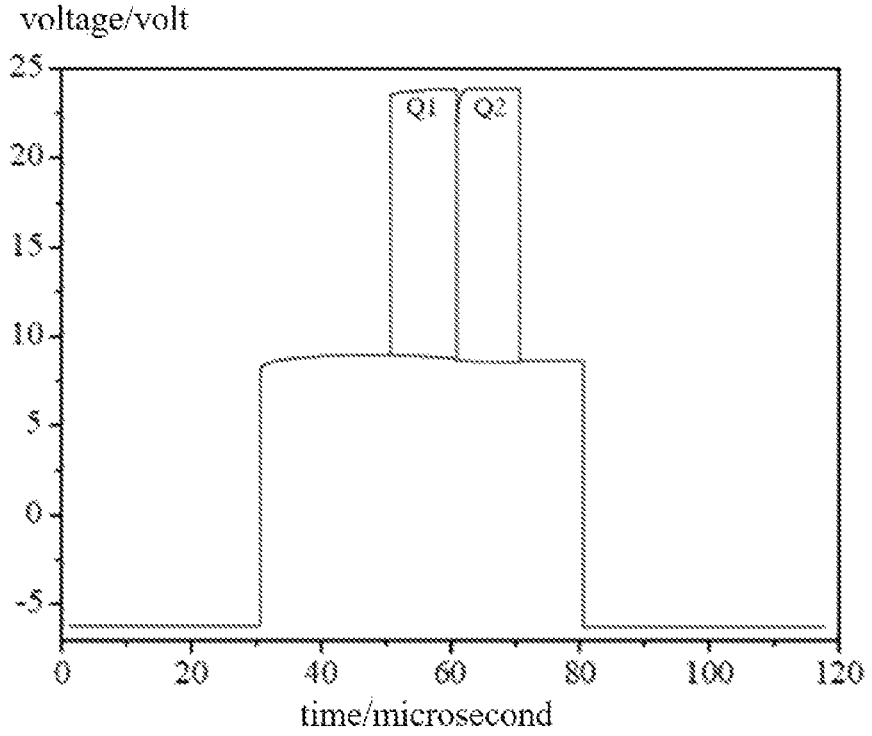
FIG. 5 is a simulation result diagram of a first pull-up node and a second pull-up node in the GOA unit shown in FIG. 4.

Specifically, please refer to FIG. 5. FIG. 5 is a simulation result diagram of the first pull-up node Q1 and the second pull-up node Q2 in the GOA unit shown in FIG. 4. The abscissa in FIG. 4 is time, and the time unit is microsecond. The ordinate in FIG. 4 is voltage, and the voltage unit is volt. As shown in FIG. 5, the high-level signal VGH in the GOA circuit is usually 9V. According to the simulation result, the bootstrap voltages of the first pull-up node Q1 and the second pull-up node Q2 have reached about 23V, so the third transistor T3 and the fourth transistor T4 can be fully turned on, thereby improving the waveform quality of the scanning signal output by each level of the GOA unit.

It should be noted that each GOA unit can correspondingly output multiple scanning signals, the number of the scanning signals is not limited and can be set according to actual needs.

Figure 6:
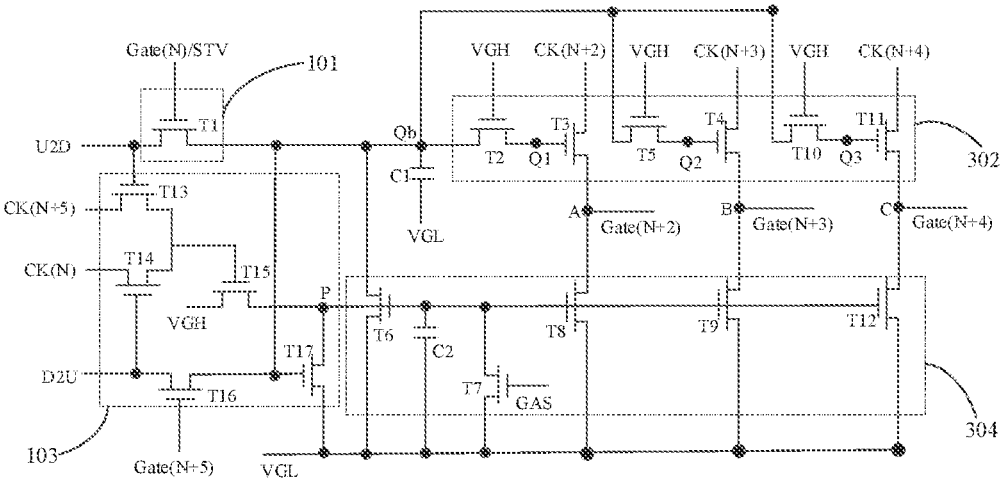
FIG. 6 is a third schematic diagram of a GOA unit in a GOA circuit provided in one embodiment of the present disclosure.

For example, please refer to FIG. 6. FIG. 6 is a third schematic diagram of a GOA unit in a GOA circuit provided in the present disclosure. As shown in FIG. 6, the difference from the GOA unit shown in FIG. 4 is that the pull-up module 302 includes a second transistor T2, a third transistor T3, a fourth transistor T4, a fifth transistor T5, a tenth transistor T10, and an eleventh transistor T11.

A gate of the second transistor T2, a gate of the fifth transistor T5, and a gate of the tenth transistor T10 all access the high-level signal VGH. A source of the second transistor T2, a source of the fifth transistor T5, and a source of the tenth transistor T10 are all electrically connected to the first node Qb. A drain of the second transistor T2 and a gate of the third transistor T3 are both electrically connected to a first pull-up node Q1. A source of the third transistor T3 accesses an N+2th level clock signal CK (N+2). A drain of the third transistor T3 is electrically connected to an output terminal A for outputting an N+2th level scanning signal. A drain of the fifth transistor T5 and a gate of the fourth transistor T4 are both electrically connected to a second pull-up node Q2. A source of the fourth transistor T4 accesses an N+3th level clock signal CK (N+3). A drain of the fourth transistor T4 is electrically connected to an output terminal B for outputting an N+3th level scanning signal. A drain of the tenth transistor T10 and a gate of the eleventh transistor T11 are both electrically connected to a third pull-up node T3. A source of the eleventh transistor T11 accesses an N+4th clock signal CK (N+4). A drain of the eleventh transistor T11 is electrically connected to an output terminal C for outputting an N+4th level scanning signal.

Correspondingly, a pull-down maintenance module 304 includes a sixth transistor T6, a seventh transistor T7, an eighth transistor T8, a ninth transistor T9, a twelfth transistor T12, and a second capacitor C2.

A gate of the sixth transistor T6, a first end of the second capacitor C2, a drain of the seventh transistor T7, a gate of the eighth transistor T8, a gate of the ninth transistor T9, and a gate of the twelfth transistor T12 are all electrically connected to the second node P. A drain of the sixth transistor T6 is electrically connected to the first node Qb. A source of the sixth transistor T6, a second end of the second capacitor C2, a source of the seventh transistor T7, a source of the eighth transistor T8, a source of the ninth transistor T9, and a source of the twelfth transistor T12 all access the low-level signal VGL. A gate of the seventh transistor T7 accesses the function control signal GAS. A drain of the eighth transistor T8 is electrically connected to the output terminal A for outputting the N+2th level scanning signal. A drain of the ninth transistor T9 is electrically connected to the output terminal B for outputting the N+3th level scanning signal. A drain of the twelfth transistor T12 is electrically connected to the output terminal C for outputting the N+4th level scanning signal.

In the embodiments of the present disclosure, by sharing part of the circuit, each GOA unit can correspondingly output the N+2th level scanning signal Gate (N+2), the N+3th level scanning signal Gate (N+3), and the N+4th level scanning signal Gate (N+4), which further simplifies the structure of the GOA circuit and thereby realizes a narrow frame design of display panels.

Figure 7:
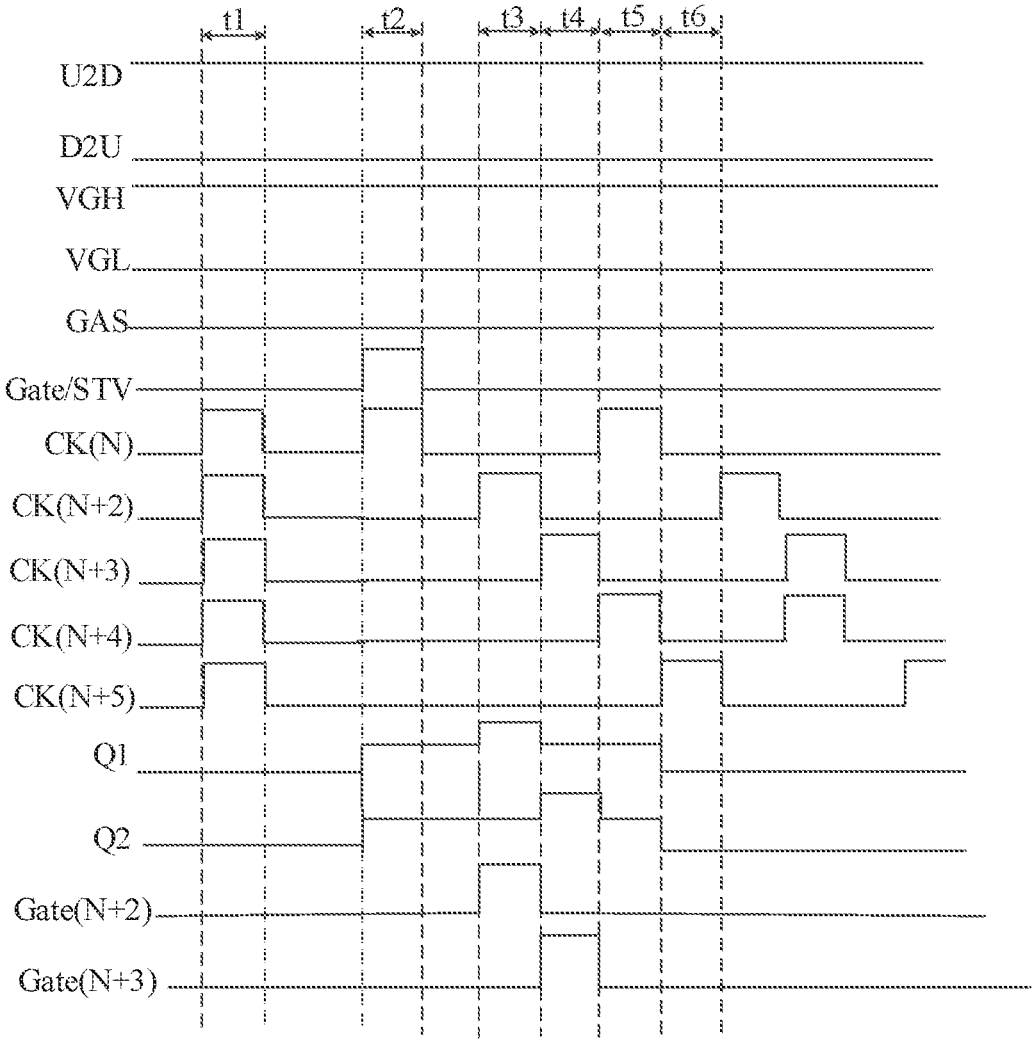
FIG. 7 is a signal timing diagram of the GOA unit shown in FIG. 4.

Further, please refer to FIG. 4 and FIG. 7. FIG. 7 is a signal timing diagram of the GOA unit shown in FIG. 4. It will take the GOA unit shown in FIG. 4 as an example to illustrate the working sequence of the GOA unit in this embodiment of the present disclosure.

The initial stage t1: the forward scanning signal U2D is at a high level, the thirteenth transistor T3 is turned on, the reverse scanning signal D2U is at a low level, and the fourteenth transistor T14 is turned off. At this moment, the clock signals CK are all set to a high level, the fifteenth transistor T15 is turned on, the electric potential of the second node P is pulled up to a high level, the eighth transistor T8 and the ninth transistor T9 are turned on, the N+2th level scanning signal Gate (N+2) and the N+3th level scanning signal Gate (N+3) are pulled down to VGL, and the initial electric potential writing is completed.

The input stage t2: the Nth level scanning signal Gate (N) or the starting signal STV rises to a high level, the first transistor T1 is turned on, the electric potential of the first node Qb is pulled up to a high level, the seventeenth transistor T17 is turned on, the electric potential of the second node P is pulled down to a low level, the eighth transistor T8 and the ninth transistor T9 are turned off. At the same time, the second transistor T2 and the fifth transistor T5 are turned on, the electric potentials of the first pull-up node Q1 and the second pull-up node Q2 are pulled up to a high level. The third transistor T3 and the fourth transistor T4 are both at the opening stage, and waiting for the arrival of the N+2th level clock signal CK (N+2) and the N+3th level clock signal CK (N+3).

The first output stage t3: the N+2th level clock signal CK (N+2) rises to a high level, the first pull-up node Q1 bootstraps the third transistor T3 to fully turn on, and the output terminal A for outputting the N+2th level scanning signal outputs a high level N+2th level scanning signal. At this moment, the N+3th clock signal CK (N+3) is at a low level, and the N+3th level scanning signal Gate (N+3) remains at a low level.

The second output stage t4: the N+2th level clock signal CK (N+2) becomes low-level, the electric potential of the first pull-up node Q1 is still on high level, the third transistor T3 is turned on, the N+2th level scanning signal Gate (N+2) is pulled down to VGL, at which point the N+2th level scanning signal Gate (N+2) is reset. At this moment, the N+3th level scanning signal Gate (N+3) rises to a high level, and the output terminal B for outputting the N+3th level scanning signal outputs a high level N+3th level scanning signal.

The first reset stage t5: when the N+4th level clock signal CK (N+4) rises to a high level, the N+3th clock signal CK (N+3) and the N+5th clock signal CK (N+5) are both on a low level, so that both the first pull-up node Q1 and the second pull-up node Q2 maintain a high level. The third transistor T3 and the fourth transistor T4 are both at the opening stage, and the N+3th level scanning signal Gate (N+3) is pulled down to VGL to realize the reset of the N+3th level scanning signal Gate (N+3).

The second reset stage t6: the N+5th clock signal CK (N+5) and the N+5th level scanning signal Gate (N+5) both rise to a high level, the fifteenth transistor T15 is turned on, the electric potential of the second node P is pulled up to a high level, the eighth transistor T8 and the ninth transistor T9 are turned on, and the N+2th level scanning signal Gate (N+2) and the N+3th clock signal CK (N+3) maintain a low level. At the same time, the sixteenth transistor T16 is turned on, and since the reverse scanning signal D2U is at a low level, the electric potential of the first node Qb is pulled down to a low level, and then the first pull-up node Q1 and the second pull-up node Q2 are both reset to a low level. The third transistor T3 and the fourth transistor T4 are turned off, so as to prevent periodic high levels of the N+2th level clock signal CK (N+2) and the N+3th level clock signal CK (N+3) from being input to the output terminal A for outputting the N+2th level scanning signal and the output terminal B for outputting the N+3th level scanning signal.

It should be noted that the transistors in the GOA circuit provided in the present disclosure all low-temperature polysilicon thin film transistors, oxide semiconductor thin film transistors or amorphous silicon thin film transistors. In addition, the transistors in the GOA circuit provided by the embodiments of the present disclosure are the same type of transistors, so as to avoid differences between different types of transistors affecting the GOA circuit.

Figure 8:
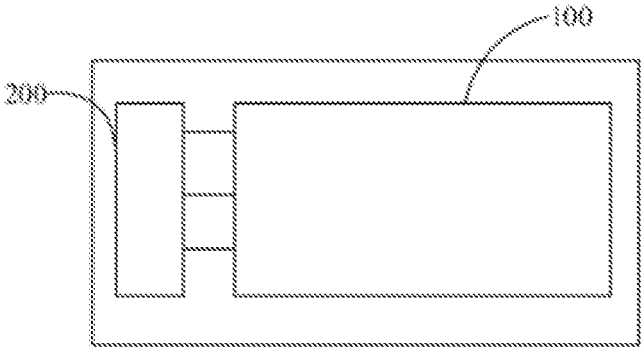
FIG. 8 is a schematic structural diagram of a display panel provided in one embodiment of the present disclosure.

Please refer to FIG. 8. FIG. 8 is a schematic structural diagram of a display panel provided in the present disclosure. As shown in FIG. 8, the display panel includes a display area and a GOA circuit 200 integrated on the edge of the display area 100. The GOA circuit 200 is similar in structure and principle to the GOA circuit described above and will not be repeated here. The display panel includes, but is not limited to, a liquid crystal display panel, an organic light-emitting diode (OLED) display panel, a light-emitting diode (LED) display panel, and a quantum dot light emitting diode (QLED) display panel.

It should be noted that the display panel provided in the embodiments of the present disclosure is introduced by taking as an example the single-side driving mode in which the GOA circuit 200 is set on one side of the display area 100, but it should not be understood as a limitation of the present disclosure. In some embodiments, other driving modes such as double-side driving may also be adopted according to actual requirements of the display panel, which is specifically limited in the disclosure.

The display panel provided in the present disclosure includes a GOA circuit. The GOA circuit includes multi-level cascaded GOA units. Each of the GOA units includes a pull-up control module, a pull-up module, a pull-down module, and a pull-down maintenance module. By sharing part of the circuit, each of the GOA units can realize multi-level scanning signal outputting, which simplifies the structure of the GOA circuit and further realizes A narrow frame design of display panels.

From the foregoing, the present disclosure is described in detail in accordance with the above contents with the specific examples, the present disclosure is not limited to the specific examples; for the person skilled in the art of the disclosure, various modifications or substitutions may be made without departing from the scope and spirit of the present disclosure, all of the modifications or substitutions should be included in the protection scope of the disclosure.

What is claimed is:

1. A gate driver on array (GOA) circuit, comprising multi-level cascaded GOA units, and the GOA unit at each level comprises: a pull-up control module, a pull-up module, a pull-down module, a pull-down maintenance module and a bootstrap capacitor, wherein:

the pull-up control module accesses an Nth level scanning signal and a forward scanning signal, the pull-up control module is electrically connected to a first node, and the pull-up control module is configured to output the forward scanning signal to the first node under control of the Nth level scanning signal;

the pull-up module accesses a high-level signal and at least two clock signals, the pull-up module is further electrically connected to the first node, the pull-up module is configured to output a scanning signal corresponding to each of the clock signals under control of the high-level signal, the clock signals, and an electric potential of the first node;

the pull-down module accesses the forward scanning signal, a reverse scanning signal, an N+5th level clock signal, an Nth level clock signal, an N+5th level scanning signal, the high-level signal, and a low-level signal; the pull-down module is electrically connected to the first node and a second node; the pull-down module is configured to pull down the electric potential of the first node under control of the forward scanning signal, the reverse scanning signal, the N+5th level clock signal, the Nth level clock signal, the N+5th level scanning signal, the high-level signal and the low-level signal;

the pull-down maintenance module accesses the low-level signal and a function control signal, the pull-down maintenance module is electrically connected to the first node, the second node and output terminals for outputting the scanning signals; the pull-down maintenance module is configured to maintain a low electric potential of the first node and a low electric potential of the corresponding scanning signal under control of the electric potential of the second node and the low-level signal; and a first end of the bootstrap capacitor accesses the low-level signal, and a second end of the bootstrap capacitor is electrically connected to the first node.

2. The GOA circuit of claim 1, wherein the pull-up control module comprises a first transistor, a gate of the first transistor accesses the Nth level scanning signal, a source of the first transistor accesses the forward scanning signal, and a drain of the first transistor is electrically connected to the first node.

3. The GOA circuit of claim 1, wherein the pull-up module comprises a second transistor, a third transistor, and a fourth transistor;

a gate of the second transistor accesses the high-level signal; a source of the second transistor is electrically connected to the first node; a drain of the second transistor, a gate of the third transistor, and a gate of the fourth transistor are all electrically connected to a pull-up node; a source of the third transistor accesses an N+2th level clock signal; a drain of the third transistor is electrically connected to an output terminal for outputting an N+2th level scanning signal; a source of the fourth transistor accesses an N+3th level clock signal; a drain of the fourth transistor is electrically connected to an output terminal for outputting an N+3th level scanning signal.

4. The GOA circuit of claim 3, wherein the pull-down maintenance module comprises a sixth transistor, a seventh transistor, an eighth transistor, a ninth transistor, and a second capacitor;

a gate of the sixth transistor, a first end of the second capacitor, a drain of the seventh transistor, a gate of the eighth transistor, and a gate of the ninth transistor are all electrically connected to the second node; a drain of the sixth transistor is electrically connected to the first node; a source of the sixth transistor, a second end of the second capacitor, a source of the seventh transistor, a source of the eighth transistor, and a source of the ninth transistor all access the low-level signal; a gate of the seventh transistor accesses the function control signal; a drain of the eighth transistor is electrically connected to the output terminal for outputting the N+2th level scanning signal; and a drain of the ninth transistor is electrically connected to the output terminal for outputting the N+3th level scanning signal.

5. The GOA circuit of claim 1, wherein the pull-up module comprises a second transistor, a third transistor, a fourth transistor, and a fifth transistor;

a gate of the second transistor and a gate of the fifth transistor both access the high-level signal, a source of the second transistor and a source of the fifth transistor are both electrically connected to the first node, a drain of the second transistor and a gate of the third transistor are both electrically connected to a first pull-up node, a source of the third transistor accesses an N+2th level clock signal, a drain of the third transistor is electrically connected to an output terminal for outputting an N+2th level scanning signal, a drain of the fifth transistor and a gate of the fourth transistor are both electrically connected to a second pull-up node, a source of the fourth transistor accesses an N+3th level clock signal, a drain of the fourth transistor is electrically connected to an output terminal for outputting an N+3th level scanning signal.

6. The GOA circuit of claim 5, wherein the pull-down maintenance module comprises a sixth transistor, a seventh transistor, an eighth transistor, a ninth transistor, and a second capacitor;

a gate of the sixth transistor, a first end of the second capacitor, a drain of the seventh transistor, a gate of the eighth transistor, and a gate of the ninth transistor are all electrically connected to the second node; a drain of the sixth transistor is electrically connected to the first node; a source of the sixth transistor, a second end of the second capacitor, a source of the seventh transistor, a source of the eighth transistor, and a source of the ninth transistor all access the low-level signal, a gate of the seventh transistor accesses the function control signal, a drain of the eighth transistor is electrically connected to the output terminal for outputting the N+2th level scanning signal, a drain of the ninth transistor is electrically connected to the output terminal for outputting the N+3th level scanning signal.

7. The GOA circuit of claim 1, wherein the pull-up module comprises a second transistor, a third transistor, a fourth transistor, a fifth transistor, a tenth transistor, and an eleventh transistor;

a gate of the second transistor, a gate of the fifth transistor, and a gate of the tenth transistor all access the high-level signal; a source of the second transistor, a source of the fifth transistor, and a source of the tenth transistor are all electrically connected to the first node; a drain of the second transistor and a gate of the third transistor are both electrically connected to a first pull-up node; a source of the third transistor accesses an N+2th level clock signal; a drain of the third transistor is electrically connected to an output terminal for outputting an N+2th level scanning signal; a drain of the fifth transistor and a gate of the fourth transistor are both electrically connected to a second pull-up node; a source of the fourth transistor accesses an N+3th level clock signal; a drain of the fourth transistor is electrically connected to an output terminal for outputting an N+3th level scanning signal; a drain of the tenth transistor and a gate of the eleventh transistor are both electrically connected to a third pull-up node; a source of the eleventh transistor accesses an N+4th clock signal, and a drain of the eleventh transistor is electrically connected to an output terminal for outputting an N+4th level scanning signal.

8. The GOA circuit of claim 7, wherein the pull-down maintenance module comprises a sixth transistor, a seventh transistor, an eighth transistor, a ninth transistor, a twelfth transistor, and a second capacitor;

a gate of the sixth transistor, a first end of the second capacitor, a drain of the seventh transistor, a gate of the eighth transistor, a gate of the ninth transistor, and a gate of the twelfth transistor are all electrically connected to the second node; a drain of the sixth transistor is electrically connected to the first node; a source of the sixth transistor, a second end of the second capacitor, a source of the seventh transistor, a source of the eighth transistor, a source of the ninth transistor and a source of the twelfth transistor all access the low-level signal; a gate of the seventh transistor accesses the function control signal; a drain of the eighth transistor is electrically connected to the output terminal for outputting the N+2th level scanning signal; a drain of the ninth transistor is electrically connected to the output terminal for outputting the N+3th level scanning signal; and a drain of the twelfth transistor is electrically connected to the output terminal for outputting the N+4th level scanning signal.

9. The GOA circuit of claim 1, wherein the pull-down module comprises a thirteenth transistor, a fourteenth transistor, a fifteenth transistor, a sixteenth transistor, and a seventeenth transistor;

a gate of the thirteenth transistor accesses the forward scanning signal; a source of the thirteenth transistor accesses the N+5th level clock signal; a drain of the thirteenth transistor is electrically connected to a drain of the fourteenth transistor and a gate of the fifteenth transistor, a source of the fourteenth transistor accesses the Nth level clock signal; a gate of the fourteenth transistor and a source of the sixteenth transistor both access the reverse scanning signal; a gate of the sixteenth transistor accesses the N+5th level scanning signal; a drain of the sixteenth transistor and a gate of the seventeenth transistor are both electrically connected to the first node; a source of the seventeenth transistor accesses the low-level signal; a drain of the seventeenth transistor and a drain of the fifteenth transistor are both electrically connected to the second node; and a source of the fifteenth transistor accesses the high-level signal.

10. The GOA circuit of claim 1, wherein a phase of the forward scanning signal is opposite to a phase of the reverse scanning signal.

11. A display panel, comprising a gate driver on array (GOA) circuit, and the GOA circuit comprises multi-level cascaded GOA units, the GOA unit at each level comprises: a pull-up control module, a pull-up module, a pull-down module, a pull-down maintenance module and a bootstrap capacitor, wherein:

the pull-up control module accesses an Nth level scanning signal and a forward scanning signal, the pull-up control module is electrically connected to a first node, and the pull-up control module is configured to output the forward scanning signal to the first node under control of the Nth level scanning signal;

the pull-up module accesses a high-level signal and at least two clock signals, the pull-up module is electrically connected to the first node, the pull-up module is configured to output a scanning signal corresponding to each of the clock signals under control of the high-level signal, the clock signals, and an electric potential of the first node;

the pull-down module accesses the forward scanning signal, a reverse scanning signal, an N+5th level clock signal, an Nth level clock signal, an N+5th level scanning signal, the high-level signal, and a low-level signal; the pull-down module is electrically connected to the first node and a second node; the pull-down module is configured to pull down the electric potential of the first node under control of the forward scanning signal, the reverse scanning signal, the N+5th level clock signal, the Nth level clock signal, the N+5th level scanning signal, the high-level signal and the low-level signal;

the pull-down maintenance module accesses the low-level signal and a function control signal; the pull-down maintenance module is electrically connected to the first node, the second node, and output terminals for outputting the scanning signals; the pull-down maintenance module is configured to maintain a low electric potential of the first node and a low electric potential of the corresponding scanning signal under control of the electric potential of the second node and the low-level signal; and a first end of the bootstrap capacitor accesses the low-level signal, and a second end of the bootstrap capacitor is electrically connected to the first node.

12. The display panel of claim 11, wherein the pull-up control module comprises a first transistor, a gate of the first transistor accesses the Nth level scanning signal, a source of the first transistor accesses the forward scanning signal, and a drain of the first transistor is electrically connected to the first node.

13. The display panel of claim 11, wherein the pull-up module comprises a second transistor, a third transistor, and a fourth transistor;

a gate of the second transistor accesses the high-level signal; a source of the second transistor is electrically connected to the first node; a drain of the second transistor, a gate of the third transistor and a gate of the fourth transistor are all electrically connected to a pull-up node; a source of the third transistor accesses an N+2th level clock signal; a drain of the third transistor is electrically connected to an output terminal for outputting an N+2th level scanning signal; a source of the fourth transistor accesses an N+3th level clock signal; and a drain of the fourth transistor is electrically connected to an output terminal for outputting an N+3th level scanning signal.

14. The display panel of claim 13, wherein the pull-down maintenance module comprises a sixth transistor, a seventh transistor, an eighth transistor, a ninth transistor, and a second capacitor;

a gate of the sixth transistor, a first end of the second capacitor, a drain of the seventh transistor, a gate of the eighth transistor, and a gate of the ninth transistor are all electrically connected to the second node; a drain of the sixth transistor is electrically connected to the first node; a source of the sixth transistor, a second end of the second capacitor, a source of the seventh transistor, a source of the eighth transistor, and a source of the ninth transistor all access the low-level signal; a gate of the seventh transistor accesses the function control signal; a drain of the eighth transistor is electrically connected to the output terminal for outputting the N+2th level scanning signal; and a drain of the ninth transistor is electrically connected to the output terminal for outputting the N+3th level scanning signal.

15. The display panel of claim 11, wherein the pull-up module comprises a second transistor, a third transistor, a fourth transistor, and a fifth transistor;

a gate of the second transistor and a gate of the fifth transistor both access the high-level signal; a source of the second transistor and a source of the fifth transistor are both electrically connected to the first node; a drain of the second transistor and a gate of the third transistor are both electrically connected to a first pull-up node; a source of the third transistor accesses an N+2th level clock signal, a drain of the third transistor is electrically connected to an output terminal for outputting an N+2th level scanning signal; a drain of the fifth transistor and a gate of the fourth transistor are both electrically connected to a second pull-up node; a source of the fourth transistor accesses an N+3th level clock signal; and a drain of the fourth transistor is electrically connected to an output terminal for outputting an N+3th level scanning signal.

16. The display panel of claim 15, wherein the pull-down maintenance module comprises a sixth transistor, a seventh transistor, an eighth transistor, a ninth transistor, and a second capacitor;

a gate of the sixth transistor, a first end of the second capacitor, a drain of the seventh transistor, a gate of the eighth transistor, and a gate of the ninth transistor are all electrically connected to the second node; a drain of the sixth transistor is electrically connected to the first node; a source of the sixth transistor, a second end of the second capacitor, a source of the seventh transistor, a source of the eighth transistor, and a source of the ninth transistor all access the low-level signal; a gate of the seventh transistor accesses the function control signal; a drain of the eighth transistor is electrically connected to the output terminal for outputting the N+2th level scanning signal; and a drain of the ninth transistor is electrically connected to the output terminal for outputting the N+3th level scanning signal.

17. The display panel of claim 11, wherein the pull-up module comprises a second transistor, a third transistor, a fourth transistor, a fifth transistor, a tenth transistor, and an eleventh transistor;

a gate of the second transistor, a gate of the fifth transistor and a gate of the tenth transistor all access the high-level signal; a source of the second transistor, a source of the fifth transistor and a source of the tenth transistor are all electrically connected to the first node; a drain of the second transistor and a gate of the third transistor are both electrically connected to a first pull-up node; a source of the third transistor accesses an N+2th level clock signal; a drain of the third transistor is electrically connected to an output terminal for outputting an N+2th level scanning signal; a drain of the fifth transistor and a gate of the fourth transistor are both electrically connected to a second pull-up node; a source of the fourth transistor accesses an N+3th level clock signal; a drain of the fourth transistor is electrically connected to an output terminal for outputting an N+3th level scanning signal; a drain of the tenth transistor and a gate of the eleventh transistor are both electrically connected to a third pull-up node; a source of the eleventh transistor accesses an N+4th clock signal; and a drain of the eleventh transistor is electrically connected to an output terminal for outputting an N+4th level scanning signal.

18. The display panel of claim 17, wherein the pull-down maintenance module comprises a sixth transistor, a seventh transistor, an eighth transistor, a ninth transistor, a twelfth transistor, and a second capacitor;

a gate of the sixth transistor, a first end of the second capacitor, a drain of the seventh transistor, a gate of the eighth transistor, a gate of the ninth transistor, and a gate of the twelfth transistor are all electrically connected to the second node; a drain of the sixth transistor is electrically connected to the first node; a source of the sixth transistor, a second end of the second capacitor, a source of the seventh transistor, a source of the eighth transistor, a source of the ninth transistor, and a source of the twelfth transistor all access the low-level signal; a gate of the seventh transistor accesses the function control signal; a drain of the eighth transistor is electrically connected to the output terminal for outputting the N+2th level scanning signal; a drain of the ninth transistor is electrically connected to the output terminal for outputting the N+3th level scanning signal; and a drain of the twelfth transistor is electrically connected to the output terminal for outputting the N+4th level scanning signal.

19. The display panel of claim 11, wherein the pull-down module comprises a thirteenth transistor, a fourteenth transistor, a fifteenth transistor, a sixteenth transistor, and a seventeenth transistor;

a gate of the thirteenth transistor accesses the forward scanning signal; a source of the thirteenth transistor accesses the N+5th level clock signal; a drain of the thirteenth transistor is electrically connected to a drain of the fourteenth transistor and a gate of the fifteenth transistor; a source of the fourteenth transistor accesses the Nth level clock signal; a gate of the fourteenth transistor and a source of the sixteenth transistor both access the reverse scanning signal; a gate of the sixteenth transistor accesses the N+5th level scanning signal; a drain of the sixteenth transistor and a gate of the seventeenth transistor are both electrically connected to the first node; a source of the seventeenth transistor accesses the low-level signal; a drain of the seventeenth transistor and a drain of the fifteenth transistor are both electrically connected to the second node; and a source of the fifteenth transistor accesses the high-level signal.

20. The display panel of claim 11, wherein a phase of the forward scanning signal is opposite to a phase of the reverse scanning signal.

* * * * *